United States Patent [19]

Hoshino et al.

[11] Patent Number: 4,767,361

[45] Date of Patent: Aug. 30, 1988

[54] CONNECTOR

[75] Inventors: Teruaki Hoshino, Higashiyamato; Koichi Kamiji, Utsunomiya, both of Japan

[73] Assignees: Japan Aviation Electronics Industry Limited; Honda Giken Kogyo Kabushiki Kaisha, both of Tokyo, Japan

[21] Appl. No.: 135,469

[22] Filed: Dec. 21, 1987

Related U.S. Application Data

[63] Continuation of Ser. No. 880,526, Jul. 1, 1986, abandoned.

[30] Foreign Application Priority Data

Jul. 8, 1985 [JP] Japan ..... 60-103677[U]

[51] Int. Cl.[4] ..... H01R 13/426; H01R 13/436

[52] U.S. Cl. ..... 439/596; 439/597; 439/603; 439/752

[58] Field of Search ..... 339/91 R, 200 P, 210 R, 339/210 M, 59 R, 59 M, 61 R, 61 M; 439/595–597, 603, 752

[56] References Cited

U.S. PATENT DOCUMENTS 4,040,703 8/1977 Shaffer et al. ..... 339/210 R X
4,114,971 9/1978 Helmbrock ..... 339/210 R X
4,607,903 8/1986 Hoshino et al. ..... 339/63 R
4,611,868 9/1986 Matsui et al. ..... 339/210 M X

*Primary Examiner*—Gil Weidenfeld
*Assistant Examiner*—Steven C. Bishop
*Attorney, Agent, or Firm*—Pollock, Vande Sande and Priddy

[57] ABSTRACT

A connector body has a plurality of contact housing holes bored therethrough for receiving socket contacts, an aperture made in one side thereof in communication with the contact housing holes, and a contact locking member molded integrally therewith to be pivotally connected thereto at one end through a hinge. The contact locking member is turned to abut against the surface of the connector body in which the aperture is made. In this state, a blocking projection formed integrally with the contact locking member projects into the contact housing holes through the aperture, locking the socket contacts. A hooked portion of the contact locking member formed integrally therewith at the other end engages a slot made in another side of the connector body. Moreover, locking means which is comprised of an engaging piece and a locking portion for engagement with a hook of the engaging piece formed at its end is provided on the connector body and the contact locking member in the vicinity of the hinge.

7 Claims, 6 Drawing Sheets

CONNECTOR

This application is a continuation of Ser. No. 880,526, filed on July 1, 1986, now abandoned.

BACKGROUND OF THE INVENTION

The present invention relates to a connector which is capable of locking socket contacts housed therein.

The present inventors have proposed, in their prior U.S. Patent Application Ser. No. 717,789 (filed on Mar. 29, 1985), now U.S. Pat. No. 4,607,903 issued Aug. 26, 1986, in particular, with reference to FIG. 12 et seq. of its drawings, a connector assembly which ensures locking of socket contacts in position, which are inserted into contact housing holes of the connector body from behind, simply by turning a contact locking member molded integrally therewith.

To facilitate a better understanding of the present invention, a description will be given first, with reference to FIGS. 1 through 4, of the above-mentioned connector assembly. As illustrated in FIG. 1, a socket connector or connector body 11 is formed by a substantially rectangular molding of a synthetic resinous material or similar insulating material, and has contact housing holes 12-1 to 12-4 bored therethrough in the front-to-back direction thereof. The contact housing holes 12-1 to 12-4 each receive a socket contact which is inserted thereinto from the back of the connector body 11. In FIG. 1, socket contacts 13-1 and 13-2 are shown to be inserted into the contact housing holes 12-1 and 12-2, respectively.

The socket contacts 13-1 and 13-2 have at one end cable connectors 13-C1 and 13-C2 gripping cables 15-1 and 15-2, respectively, and at the other end substantially rectangularly-shaped engaging portions 16-1 and 16-2 for receiving pin contacts of the mating pin connector.

The connector body 11 has flap-like contact locking members 21-1 and 21-2 molded integrally therewith to be pivotally connected to upper and lower marginal edges of its one side through hinges 20-1 and 20-2. The contact locking members 21-1 and 21-2 pivot through the hinges 20-1 and 20-2 about axes parallel to the front-to-back direction. The contact locking member 21-1 has at one marginal portion a blocking projection 22-1 molded integrally therewith, which projection is inserted into the connector body 11 when the contact locking member 21-1 is turned to its contact locking position on the connector body 11 (a recess 14 made in the top of the connector body 11 in FIGS. 1 and 2). The connector body 11 has an aperture 23-1 made in the bottom of the recess 14 for receiving the blocking projection 22-1. The aperture 23-1 communicates with the contact housing holes 12-1 and 12-3 so that the blocking projection 22-1 partly projects thereinto when the contact locking member 21-1 is held in the recess 14 of the connector body 11. The contact locking member 21-2 also has a similar blocking projection 22-2 (not shown), and the connector body 11 has an aperture 23-2 (not shown) for receiving the blocking projection 22-2.

The contact locking members 21-1 and 21-2 and the connector body 11 are respectively provided with means for locking them together. The end portions of the contact locking members 21-1 and 21-2 on the side opposite from the hinges 22-1 and 22-2 are bent substantially at right angles so that they extend in the direction of projection of the blocking projections 22-1 and 22-2, forming hooked portions 25-1 and 25-2 which have inwardly projecting pawls 26-1 and 26-2 at their extended end portions, respectively. On the other hand, the connector body 11 has slots 35-1, 35-2 made in one side thereof which are contiguous to the recess 14, as shown in FIG. 3. The pawl 26-1 is engaged with the slot 35-1; in this state, the contact locking member 21-1 receives a returning force F caused by the resiliency of the hinge 20-1, locking the pawl 26-1 in the slot 35-1. Thus, the contact locking member 21-1 is held in its contact locking position on the connector body 11. In a similar manner, the other contact locking member 21-2 can be locked by engaging the pawl 26-2 with the slot 35-2.

When the blocking projection 22-1 stays in the aperture 23-1, rear edges of projections 19 of the socket contact 13-1 lie adjacent the front face of the blocking projection 22-1, as depicted in FIG. 2. Accordingly, when turning the contact locking member 21-1 to its contact locking position after inserting the socket contact 13-1 into the contact housing hole 12-1 to reach its normal position, the pawl 26-1 of the hooked portion 25-1 can be fitted into the slot 35-1, by which it is confirmed that the socket contact 13-1 has been inserted to its normal position. Furthermore, even if the socket contact 13-1 is pulled backward, its projections 19 will get into engagement with the blocking projection 22-1, by which the socket contact 13-1 is blocked from its further backward movement to thereby ensure locking the socket contact 13-1 in position. In a case where the socket contact 13-1 has not fully been inserted into the contact housing hole 12-1, the projections 19 of the socket contact 13-1 lie just under the aperture 23-1, so when the contact locking member 21-1 is turned toward its contact locking position, its blocking projection 22-1 will collide against the projections 19, with the result that the pawl 26-1 of the hooked portion 25-1 cannot be fitted into the slot 35-1, indicating that the socket contact 13-1 is out of place.

The other socket contacts are also locked in the connector body 11 by the contact locking member 22-1 or 22-2 in a likewise manner. Incidentally, small holes 17 in the top of the connector body 11 are provided for inserting a jig (not shown) by which resilient engaging pieces 18 of the socket contact are disengaged from a lug (also not shown) in the contact housing hole when the socket contact is removed from the connector body 11.

As described above, according to the connector assembly proposed previously, it is possible with the contact locking member to make sure of locking the socket contacts in position in the connector body simply by turning the contact locking members 21-1 and 21-2, which are molded integrally with the connector body 11 through the hinges 20-1 and 20-2, to their contact locking position, without requiring any particular separate parts therefor. However, the hinges 22-1 and 22-2 become less elastic through aging and by repeated turning operations of the contact locking members 21-1 and 21-2; so that when even a relatively weak external force is applied to the contact locking members 21-1 and 21-2, the hinges 20-1 and 20-2 may easily be broken or cut. For example, where the hinge 20-1 is broken, the contact locking member 21-1 will disengage from the connector body 11 and fall off therefrom. In this instance, the socket contact 13-1 is locked to the connector body 11 only by engagement between the resilient engaging pieces 18 and the aforementioned lug in the contact housing hole 12-1, so the locking is insufficient and the socket contact 13-1 is likely to come off from the connector body 11. Furthermore, when the socket contact 13-1 is to be replaced because of its defect or bad connection between it and the cable 15-1, it is not possible to make sure the inserted position of the new socket contact and lock it unless the contact locking member 21-1 is present.

SUMMARY OF THE INVENTION

It is therefore an object of the present invention to provide a connector which is capable of making sure that socket contacts have been fully inserted into contact housing holes and which ensures locking the contact locking member to the connector body even if the hinge therebetween is broken.

According to the present invention, means for locking the contact locking member and the connector body to each other is provided on the former near the hinge as well. In the connector of the present invention, the connector body made of a synthetic resinous material has a plurality of contact housing holes bored therethrough in its front-to-back direction for receiving socket contacts. The connector body has a contact locking member molded integrally therewith to be pivotally connected to its one marginal edge through a hinge. When the contact locking member is turned to and held in its contact locking position on the connector body, a blocking projection formed as one body with the contact locking member extends into the contact housing holes through an aperture made in the connector body. The front face of the blocking projection is opposite rear edges of projections formed integrally with each of the socket contacts inserted in the contact housing holes. The free end portion of the contact locking member on the opposite side from the hinge is bent substantially at right angles to extend in the direction of protrusion of the blocking projection, forming a hooked portion which has an inwardly projecting pawl at its end. The hooked portion abuts against one side of the rectangular connector body that is perpendicular to another side in which the above-mentioned aperture is made, and the pawl engages a slot made in that former side, by which the contact locking member is held in its contact locking position on the connector body. The end portion of the contact locking member near the hinge and the connector body are provided with locking means which comprises an engaging piece which has an elastically displaceable hook at its end and extends in the same direction as does the hooked portion, and a locking portion for engagement with the hook.

With such an arrangement, even if the hinge is broken, the contact locking member will be retained in position on the connector body by the pawl of the hooked portion and the slot held in engagement with each other and the locking means, ensuring locking of the socket contacts. The engaging piece of the locking means is formed integrally with one of the contact locking member and the connector body, and the locking portion is formed integrally with the other.

DESCRIPTION OF THE PREFERRED EMBODIMENTS

Figure 1:
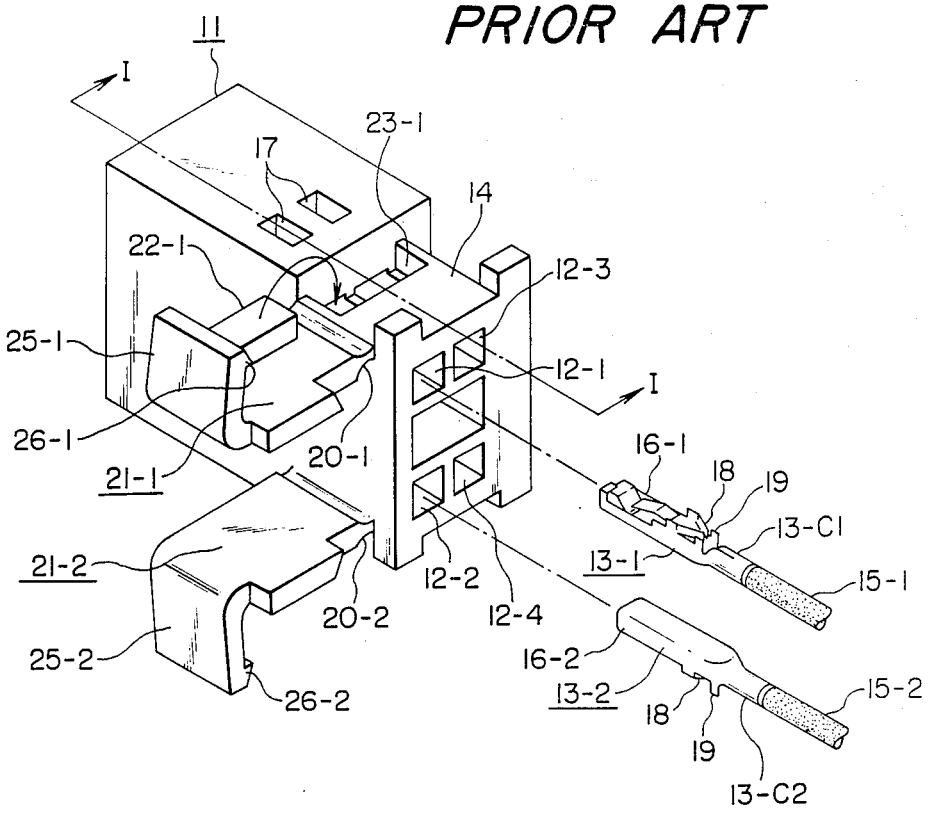
FIG. 1 PRIOR ART
FIG. 1 is an exploded perspective view showing a connector assembly proposed previously by the present inventors.
Figure 2:
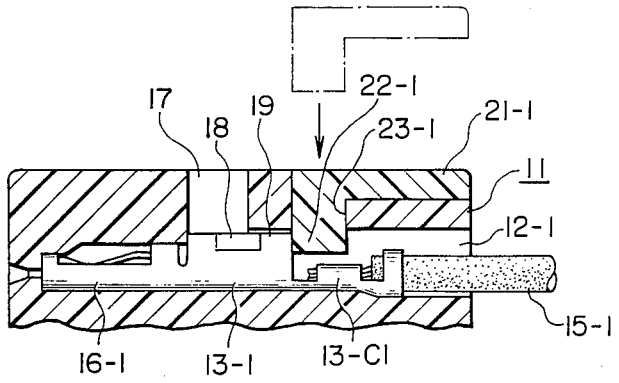
FIG. 2 PRIOR ART
FIG. 2 is a sectional view taken along the line I—I in FIG. 1, showing one part of the connector assembly.
Figure 3:
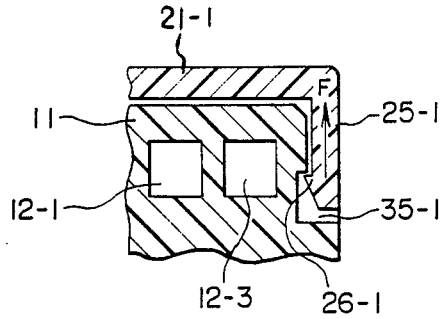
FIG. 3 PRIOR ART
FIG. 3 is a sectional view illustrating the engagement between a contact locking member 21-1 and a connector body 11 of the connector assembly shown in FIG. 1.
Figure 4:
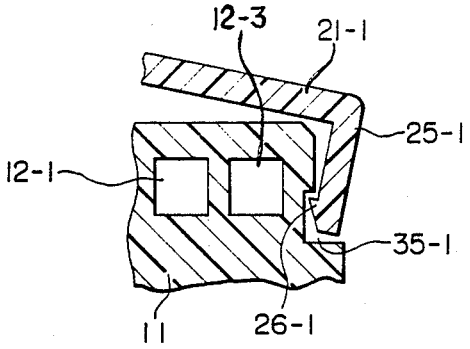
FIG. 4 PRIOR ART
FIG. 4 is a sectional view showing how the contact locking member 21-1 comes off from the connector body 11 when a hinge 20-1 is broken.
Figure 5:
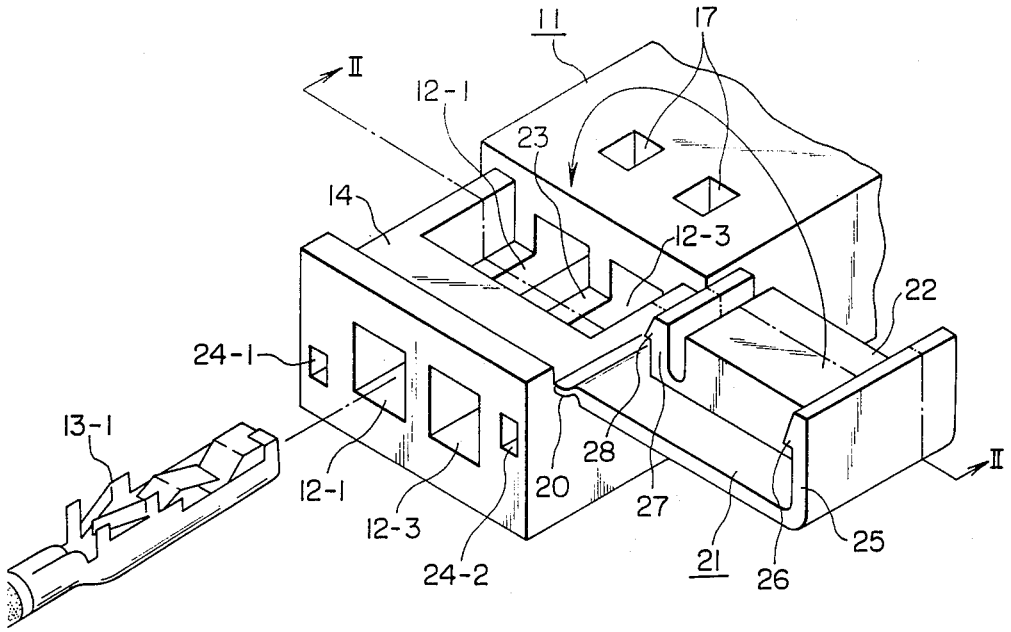
FIG. 5 is an exploded perspective view, partly cut away, illustrating an example of the connector of the present invention.
Figure 6:
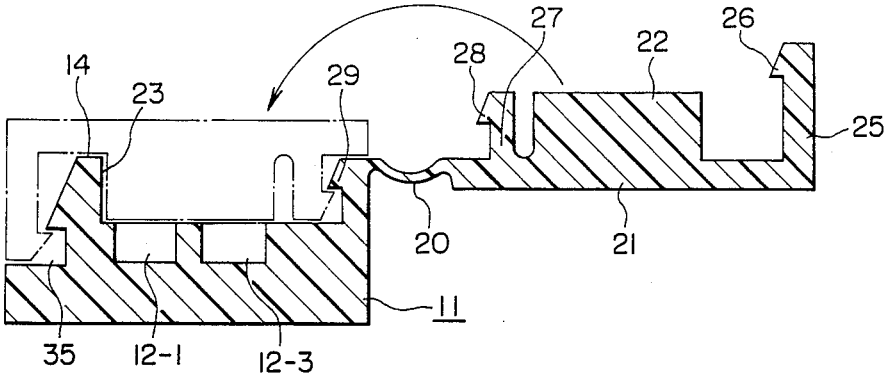
FIG. 6 is a sectional view taken along the line II—II in FIG. 5.

FIGS. 5 and 6 illustrate an embodiment of the connector of the present invention, in which the parts corresponding to those in FIGS. 1 through 3 are identified by similar reference numerals and no detailed description will be given of them. In this embodiment the connector body 11 has two contact housing holes 12-1 and 12-3; in FIG. 5 the socket contact 13-1 is shown to be inserted into the contact housing hole 12-1, but it is not shown in FIG. 6 for the sake of simplicity.

The contact locking member 21 has an engaging piece 27 molded integrally therewith on the side of the hinge 20 with respect to the blocking projection 22. The engaging piece 27 is parallel to the front-to-back direction of the connector body 11 and protrudes in the same direction as does the blocking projection 22. The projecting end of the engaging piece 27 forms an engaging hook 28 projecting toward the hinge 20. The engaging hook 28 is displaceable by elastic deformation of the engaging piece 27. The connector body 11 has the aperture 23 made therein in such a manner as to receive the engaging piece 27 as well as the blocking projection 22 when the contact locking member 21 is held in its contact locking position, as indicated by the one-dot chain line in FIG. 6. Furthermore, the connector body 11 has a locking portion 29 by which the engaging hook 28 is locked in a slot made in the side wall of the aperture 23 which is opposite the engaging piece 27 when it lies in the aperture 23.

With such a structure, when the contact locking member 21 is turned to lie flat on the bottom of the recess 14 of the connector body 11, as depicted in FIG. 6, the pawl 26 of the hooked portion 25 is slightly displaced to the left by its contact with the edge of the connector body 11 and then snaps back into the slot 35 for engagement therewith. Likewise, the engaging hook 28 of the engaging piece 27 is elastically displaced to the left by its contact with the edge of the locking portion 29 and then snaps back into engagement therewith. Thus, the contact locking member 21 is retained in position on the connector body 11 by the engagement of the pawl 26 of the hooked portion 25 with the slot 35 and the engagement of the hook 28 of the engaging piece 27 with the locking portion 29. Accordingly, even if the hinge 20 is cut by some cause, the contact locking member 21 will not fall off from the connector body 11 but will remain locked thereon, thus ensuring the locking of the socket contacts. Upon request, holes 24-1 and 24-2 may be formed in a rear surface of the body 11 to reach the slot 35 and a bottom corner of the aperture 23-1 near the hinge 20 so that the engagement of the pawl 26 and the hook 28 with the slot 35 and the locking portion 29 can be released by inserting wedge-like pins into the holes 24-1 and 24-2.

Figure 7:
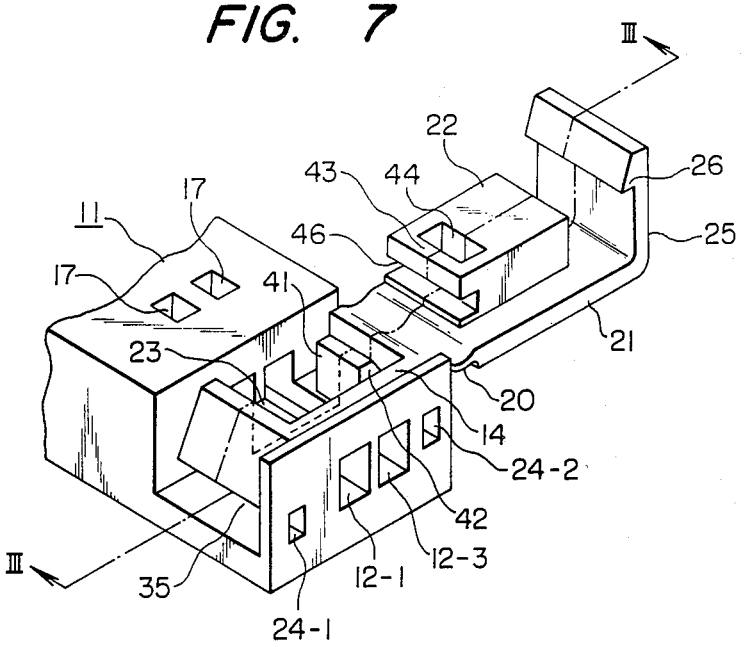
FIG. 7 is a perspective view showing a part of another example of the connector of the present invention in which an engaging piece 41 is provided on the connector body.
Figure 8:
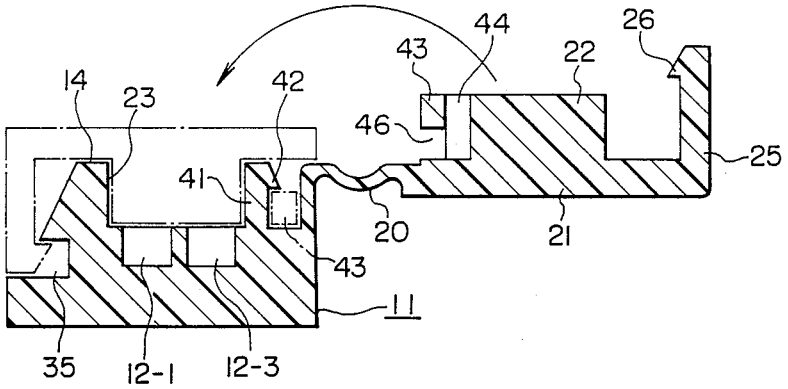
FIG. 8 is a sectional view taken along the line III—III in FIG. 7.

FIGS. 7 and 8 illustrate another embodiment of the present invention which has an engaging piece 41 protrusively provided on the bottom of the aperture 23 near the hinge 20, a hook 42 formed integrally with the engaging piece 41 at the top end portion thereof on the side of the hinge 20, and a locking portion 43 formed integrally with the contact locking member 21 near the hinge 20 for engagement with the hook 42 of the engaging piece 41 when the contact locking member 21 is held on the bottom of the recess 14 of the connector body 11. The engaging piece 41 is formed in parallel to the front-to-back direction of the connector body 11. In this embodiment, the blocking projection 22 is extended toward the hinge 20 and the locking portion 43 is formed by a hole 44 made in the extended portion of the blocking projection 22 for receiving the engaging piece 41 therein and a slot 46 made in one side wall of the hole 44 for engagement with the hook 42. In FIGS. 7 and 8 no socket contacts are depicted for the sake of brevity.

Figure 9:
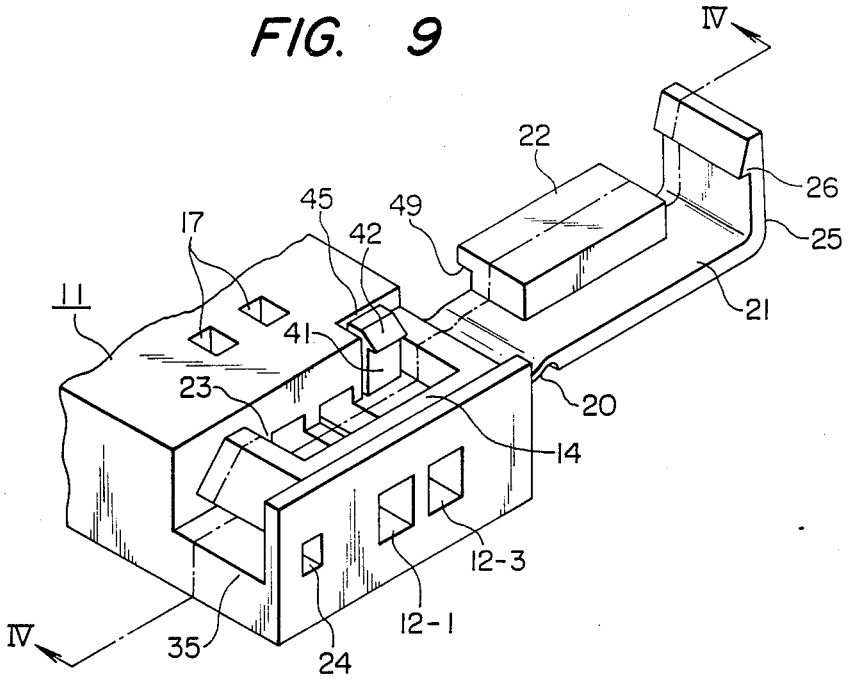
FIG. 9 is a perspective view showing a part of another example of the connector of the present invention in which an engaging piece 42 is provided on the connector body in a manner to be displaceable in the front-to-back direction thereof.
Figure 10:
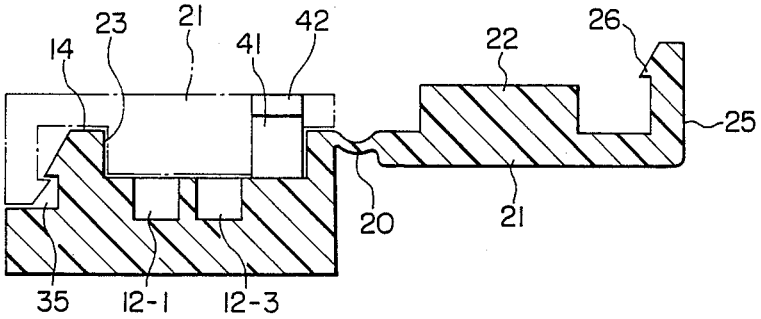
FIG. 10 is a sectional view taken along the line IV—IV in FIG. 9.

While in the two embodiments described above the engaging pieces 27 and 41 are formed in a manner to be displaceable crosswise of the connector body 11, they may also be formed to displace lengthwise thereof, as shown in FIGS. 9 and 10. The aperture 23 is enlarged toward the hinge 20 and has a recess 45 made in its side wall at one corner near the hinge 20. In the recess 45 an engaging piece 41 is provided protrusively from the bottom of the aperture 23 and has an engaging hook 42 formed on the back of its projecting end. The engaging piece 41 is parallel to the rotation plane of the contact locking member 21. On the other hand, the blocking projection 22 of the contact locking member 21 is extended toward the hinge 20 and a locking portion 49 is provided in the front end face of the extended portion. When the contact locking member 21 is turned onto the bottom of the recess 14, the front edge of the extended portion of the blocking projection 22 makes contact with the hook 42, by which the engaging piece 41 is elastically curved and the hook 42 is displaced forward and then snaps back into engagement with the locking portion 49.

Figure 11:
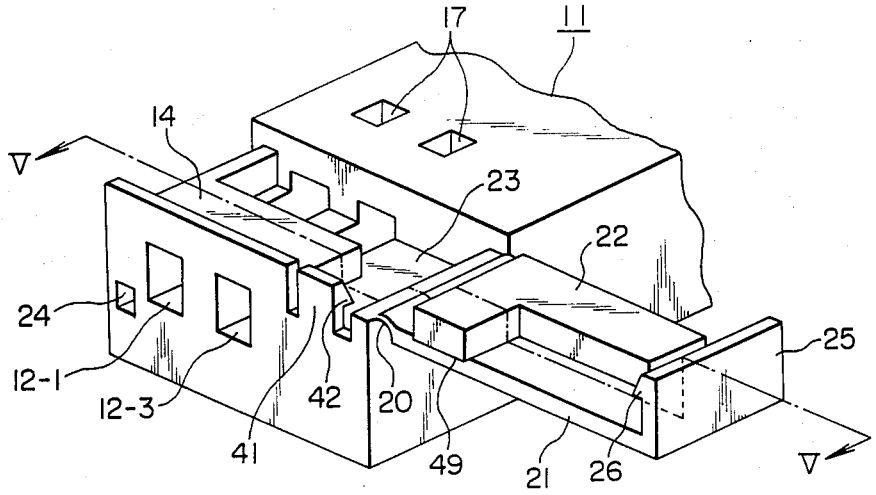
FIG. 11 is a perspective view showing a part of another example of the connector of the present invention in which an engaging piece 42 is provided on the connector body in a manner to be displaceable in the front-to-back direction thereof.
Figure 12:
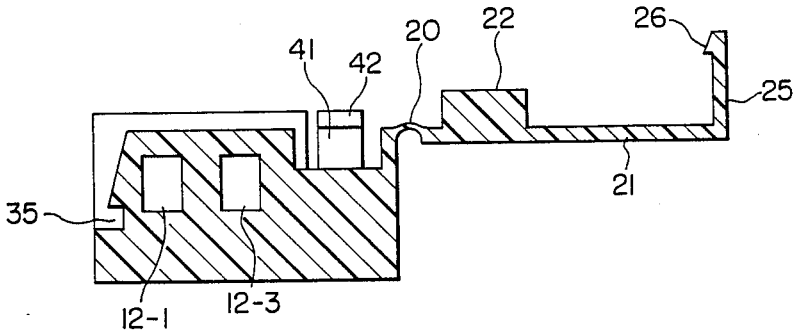
FIG. 12 is a sectional view taken along the line V—V in FIG. 11.

Also it is possible to adopt such a structure as illustrated in FIGS. 11 and 12. In this embodiment, the contact locking member 21 has a locking portion 49 provided on the back of the blocking projection 22 extended toward the hinge 20, whereas the connector body 11 has an engaging piece 41 molded integrally therewith in opposing relation to the back of the blocking projection 22. The engaging piece 41 has at its projecting end a hook 42 for engagement with the locking portion 49 when the contact locking member 21 is held in position on the bottom of the recess 14 of the connector body 11.

It will be apparent that many modifications and variations may be effected without departing from the scope of the novel concepts of the present invention.

What is claimed is:

1. A connector comprising:

a connector body formed of a synthetic resinous material and having a plurality of spaced elongated socket contact housing holes bored therethrough in parallel relation to one another, said connector body also having an aperture in one side thereof in communication with said socket contact housing holes;

a plurality of socket contacts respectively inserted into said contact housing holes of the connector body;

a contact locking member molded integrally with the connector body to be pivotally connected thereto at one end of said locking member through a hinge that defines an axis of rotation parallel to the directions of elongation of said contact housing holes, said contact locking member having a blocking projection formed integrally therewith to be inserted into said aperture of the connector body so as to project out of the aperture and into the contact housing holes to lock into place the socket contacts in said contact housing holes, said contact locking member having at its other end a hooked portion formed integrally therewith for locking engagement with a slot made in an exterior side of the connector body that is comparatively widely spaced from said hinge to thereby hold the blocking projection in the aperture;

further locking means provided on the connector body and the contact locking member for retaining said blocking projection in said aperture, said further locking means comprising an elastically displaceable engaging piece provided on one of said connector body and said contact locking member closely adjacent to said hinge, said elastically displaceable engaging piece projecting in the same direction as the hooked portion and having a hook thereon and a locking portion on the other of said connector body and said contact locking member for locking engagement with said hook in the direction in which the engaging piece projects; and a guide hole formed in said connector body in communication with said slot in the exterior side of the connector body, said guide hole being in alignment with said hooked portion of said contact locking member when said hooked portion is in locking engagement with said slot, whereby a pin can be inserted via said guide hole into abutment with said hooked portion to release the locking engagement between said hooked portion and said slot.

2. A connector according to claim 1 wherein said engaging piece is molded integrally with the contact locking member near the hinge, and the locking portion is a slot made in a side wall of the aperture adjacent to the hinge for receiving the hook.

3. A connector according to claim 1 wherein said engaging piece is formed integrally with the connector body to extend upward from a wall of the aperture adjacent the hinge, the locking portion being formed integrally with the contact locking member near the hinge for engagement with the hook of the engaging piece.

4. A connector according to claim 3 wherein the blocking projection includes a portion located adjacent to the hinge, a hole large enough to receive the engaging piece being provided in said portion of said blocking projection, and said locking portion being formed in said hole.

5. A connector according to claim 1 wherein the aperture has a recess in a side wall thereof near the hinge, the engaging piece being located in said recess in a manner to be elastically displaceable in a direction parallel to the axis of rotation defined by said hinge, said locking portion engageable with the hook of the engaging piece being formed on a portion of the blocking projection.

6. A connector according to claim 1 wherein the blocking projection includes a portion which extends toward the hinge, the locking portion being formed on said extended portion of said blocking projection, and said engaging piece having a hook engageable with the locking portion formed on a side wall of the aperture, the engaging piece being elastically displaceable in a direction transverse to the rotation plane of the contact locking member.

7. The connector of claim 1 including a further guide hole formed in said connector body in communication with said locking portion, said further guide hole being in alignment with said hook on said elastically displaceable engaging piece when said hook and locking portion are in locking engagement with one another, whereby a pin can be inserted via said further guide hole into abutment with said hook to release the locking engagement between said hook and said locking portion.

* * * * *